US008261917B2

(12) United States Patent
Enenkel et al.

(10) Patent No.: US 8,261,917 B2
(45) Date of Patent: Sep. 11, 2012

(54) APPARATUS AND METHOD FOR PROCESSING ARTICLES OF DIFFERENT DIMENSIONS

(75) Inventors: Peter Enenkel, Constance (DE); Holger Schererz, Rehfelde (DE); Armin Zimmermann, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 53 days.

(21) Appl. No.: 12/938,871

(22) Filed: Nov. 3, 2010

(65) Prior Publication Data

US 2011/0100881 A1 May 5, 2011

(30) Foreign Application Priority Data

Nov. 3, 2009 (DE) ..... 10 2009 046 324

(51) Int. Cl.
*B07B 13/00* (2006.01)

(52) U.S. Cl. ..... 209/659; 209/540; 209/541; 209/900; 271/3.21; 271/251

(58) Field of Classification Search ..... 209/539, 209/540, 541, 552, 586, 629, 632, 659, 900; 271/3.21, 251
See application file for complete search history.

(56) References Cited

U.S. PATENT DOCUMENTS

| | | | | |
|---|---|---|---|---|
| 3,059,770 | A * | 10/1962 | Fichtmuller | 209/632 |
| 3,513,972 | A * | 5/1970 | Tsutomu et al. | 209/629 |
| 3,955,812 | A * | 5/1976 | Suda et al. | 271/286 |
| 5,115,918 | A * | 5/1992 | DeWitt et al. | 209/3.1 |
| 5,505,440 | A * | 4/1996 | Uematsu | 271/258.01 |
| 6,186,312 | B1 * | 2/2001 | Schererz | 198/406 |
| 6,521,854 | B2 * | 2/2003 | Tanimoto | 209/586 |
| 6,715,755 | B2 * | 4/2004 | Sussmeier | 271/251 |
| 7,644,915 | B2 * | 1/2010 | Schwarzbauer et al. | 271/3.21 |
| 2007/0176353 | A1 * | 8/2007 | Steinhuebel | 271/150 |

FOREIGN PATENT DOCUMENTS

| | | |
|---|---|---|
| DE | 1 054 015 | 3/1959 |
| DE | 1 774 625 A1 | 10/1971 |
| DE | 196 12 525 A1 | 10/1997 |
| DE | 196 12 525 C2 | 10/1997 |
| DE | 100 38 690 C1 | 7/2001 |
| DE | 101 48 226 C1 | 4/2003 |
| DE | 10 2004 037 420 B3 | 12/2005 |

* cited by examiner

*Primary Examiner* — Terrell Matthews
(74) *Attorney, Agent, or Firm* — Laurence A. Greenberg; Werner H. Stemer; Ralph E. Locher

(57) ABSTRACT

An apparatus and a method stand up and process articles of different dimensions, in particular flat mail items. A conveying device transports articles to an up-ending apparatus. The up-ending apparatus transports the articles further and, in the process, up-ends the articles such that the up-ended articles stand on an edge. Up-ended articles are transported to a separating apparatus. The separating apparatus separates flat articles such that a stream of upright, spaced-apart articles leaves the separating apparatus. Up-ended and separated articles are transported to a format-separating device. The format-separating device divides the articles as a function of the dimensions thereof into article classes such that all of the articles of a set of articles belong to the same format class. All of the articles of a set of articles are transported as a stream of upright and spaced-apart articles to an appropriate processing device. The processing device processes the articles.

9 Claims, 13 Drawing Sheets

APPARATUS AND METHOD FOR PROCESSING ARTICLES OF DIFFERENT DIMENSIONS

CROSS-REFERENCE TO RELATED APPLICATION

This application claims the priority, under 35 U.S.C. §119, of German application DE 10 2009 046 324.0, filed Nov. 3, 2009; the prior application is herewith incorporated by reference in its entirety.

BACKGROUND OF THE INVENTION

Field of the Invention

The invention relates to an arrangement and to a method for processing flat articles of different dimensions, in particular flat mail items.

U.S. Pat. No. 5,505,440 describes a "culler-facer-canceler" for mail items. Mail items of different formats are tipped onto a "feed hopper 13". A "feed conveyor 17" transports the mail items to a "thickness selecting unit 19". Mail items, the respective thickness of which lies within a predetermined range, pass onto a "conveyor 21". The remaining mail items pass to a "reject unit 23". A "flats ejector 25" has a "trough conveyor 27" which up-ends mail items, wherein the mail items are transported on the "conveyor 21". A plurality of "selectors 31a, 31b, 31c, 31d" sort out mail items having a dimension "width" outside a predetermined range. An "aligning unit 33" aligns the mail items. The remaining mail items are transported by a "transport path 35" to a "buffer 37". A "vacuum chamber 39" in the "buffer 37" causes the mail items to leave the "buffer 37" one after another. The mail items pass to a "shingler conveyor 41". It is checked in the "shingler conveyor 41" whether two mail items are overlapping during transport, for which purpose a plurality of "length measuring sensors 99" are used. Overlapping mail items are transported back to the "flats ejector 25". Mail items which are not overlapping pass to a "first reader 53" and a "second reader 59" which detect franking marks on the mail items. A "canceling unit 63" cancels franking marks.

Published, non-prosecuted German patent application DE 1054015 A, corresponding to U.S. Pat. No. 3,059,770, describes an arrangement for sorting flat mail items. The arrangement has a container 2 and a spirally coiled conveying path 3a on which the container 2 can be transported. Mail items of different formats are tipped into the container 2 and are transported away by the conveying path 3a. Narrow mail items leave the conveying path 3a through slots 4 in the outer wall and pass into a conveying channel 3b. In the conveying channel 3b, mail items are up-ended by an inclined base surface. The larger mail items, for example packages, remain in the conveying path 3a and leave the arrangement through a tangentially emerging section 5. The narrow mail items are transported in the conveying channel 5b to apparatuses 6, 7 where the mail items are sorted according to size and height. Smaller mail items pass into the channels 8, 9 while larger mail items remain in the channel 10. The channels 5, 8, 9, 10 lead to various processing devices. The slots 4 and the apparatuses 6, 7 therefore act as format-splitting devices.

Published, non-prosecuted German patent application DE 19612525 A1 describes an apparatus which sorts out flat articles of excessive height from a stream of articles. The flat articles are transported upright in a transport channel 1, with it being possible for a plurality of articles to partially overlap. A first extraction step has two belts 2, which are guided obliquely upward, and a chute 5. The two belts 2 extract a mail item of excessive height out of the transport channel 1. The mail items which are not extracted are deflected in an arc-shaped manner through 180° via a deflecting section 4 and transported to a combiner 3. Mail items which are extracted by the first extraction step enter a secondary channel 7. In the secondary channel 7, the mail items reach a second extraction step and a third extraction step. Mail items which really are too large are separated there from normal items which are standing on edge and are carried along. The normal items reach the combiner 3.

U.S. Pat. No. 6,715,755 B2 describes an apparatus which actively aligns a mail item with the lower edges thereof and, in the process, changes the direction in which the mail item is being transported by, for example, 90°. A plurality of first rollers are rotatable about axes of rotation which lie in a perpendicular plane and are inclined with respect to the vertical by, for example, 45°. The first rollers change the transport direction of the mail item. A plurality of further rollers are rotatable about horizontal axes of rotation and press the mail item onto a horizontal conveyor belt.

U.S. Pat. No. 6,186,312 B1 describes an apparatus which transports a stream of mail items and, in the process, turns the transported mail items from a horizontal position into a vertical position. For this purpose, an underfloor conveyor belt transports the mail items onto a directional buffer and, as the transport continues, the directional buffer up-ends the mail items.

German patents DE 10148226 C1 and DE 10038690 C1 describe apparatuses for separating flat mail items according to thickness classes. Published, non-prosecuted German patent application DE 1774625 A, corresponding to U.S. Pat. No. 3,513,972, describes an apparatus which sorts sheet-like articles with regard to size and weight.

The apparatus described in German patent DE 10148226 C1 has a cascade of individual separating devices. Each step has two conveyor belts which are both inclined downward and form a V. A clearance occurs between the conveyor belts. A mail item drops either through the gap or is transported away by the two conveyor belts of the step.

The apparatus described in German patent DE 10038690 C1 is used to separate mail items according to formats, i.e. to screen mail items. The apparatus has a rotating drum. Lamellae in the circumferential surface of the drum bound a plurality of slots. The width of the slots can be changed. There are two membranes in the interior of the drum. Mail items are prevented by the two membranes from dropping freely through the entire drum.

German patents DE 19612525 C2 and DE 102004037420 B3, corresponding to U.S. Pat. No. 7,644,915, describe transport channels for transporting mail items.

SUMMARY OF THE INVENTION

It is accordingly an object of the invention to provide an apparatus and a method for processing articles of different dimensions which overcome the above-mentioned disadvantages of the prior art methods and devices of this general type, in which each processing device can process articles of one format class, and wherein it is ensured that each article passes to the appropriate processing device without a format-splitting device being required for screening the articles by slots or the like.

The arrangement according to the solution is capable of separating flat articles, for example flat mail items, sheets of paper, bank notes or data storage cards. Each flat article extends in an article plane.

At least two format classes are specified for the articles. Each article, owing to a physical property thereof, belongs to one format class.

The configuration contains a conveying device, a separating apparatus, a format-splitting device, and at least one processing device per specified format class.

Each processing device for a format class is capable of processing flat articles of the format class.

The configuration is capable of transporting articles which are to be processed and which have been tipped onto the conveying device along a conveyor track to the separating apparatus and from the separating apparatus to the format-splitting device. The conveyor track may contain rectilinear or curved sections. The separating apparatus is located upstream of the format-splitting device, as seen in the respective transport direction in which the articles are being transported via the conveyor track.

The separating apparatus is capable of separating flat articles and of transporting the articles further. The separating operation results in the production of a stream with a sequence of spaced-apart articles leaving the separating apparatus. After the separating operation, two articles do not overlap, as seen perpendicular to the transport direction in which the articles are being transported away from the separating apparatus. On the contrary, there is always a gap between two consecutive articles in the sequence.

The arrangement is capable of transporting separated articles further from the separating apparatus to the format-splitting device.

The format-splitting device is capable of dividing flat articles as a function of the dimensions thereof into article classes in such a manner that all of the articles of a set of articles belong to the same format class.

The arrangement is capable of transporting all of the articles of a set of articles in the form of a stream of upright, spaced-apart articles to at least one processing device in each case. The processing device is configured to process articles of the format class.

The processing device is capable of processing the articles transported thereto.

The invention makes it possible to process articles of both format classes. A respective processing device is provided for each format class. This configuration avoids the necessity of having to discard articles of one format class, meaning that these articles which have been discarded cannot be processed at all.

According to the solution, articles are first of all separated such that a stream of spaced-apart articles which may belong to different format classes leaves the separating apparatus in a random sequence. The articles are first of all separated and, only after the separating operation, are split up in accordance with the at least two format classes. Splitting-up of articles which have already been separated is simpler and less susceptible to causing jams than format-splitting using a drum or similar elements. The risk of an article being damaged during the format-splitting operation is reduced.

Since the articles are split up after the separating operation, better methods for measuring the articles can be employed than in known apparatuses. A measurement of this type is required in order to determine to which format class an article belongs. This determination of the format class is in turn required in order to transport each article to an appropriate processing device. For example, an article can be measured by an image of the article being produced and evaluated. The article is otherwise measured by means of light barriers. If articles were still overlapping, such a measurement would be possible only with difficulty and would be error-prone.

Furthermore, an article can be weighed after the separating operation. This makes it possible for the articles to be additionally divided up between the at least two processing devices as a function of the weight.

The articles are preferably transported in a permanently gripped manner after the separating operation. It is possible as a result to determine the current location of each article at any time, for which purpose the transport speed which a conveying device of the arrangement attains is determined. If required, the permanently gripped article can be rotated or turned.

The arrangement preferably additionally contains an up-ending apparatus. The up-ending apparatus is arranged upstream of the separating apparatus. The conveying device is capable of transporting flat articles which have been tipped onto the conveying device to the up-ending apparatus. The up-ending apparatus is capable of further transporting flat articles which have been transported to the up-ending apparatus and, in the process, of up-ending the articles in such a manner that, after the up-ending operation, the flat articles each stand on an edge.

This configuration makes it possible for only upright articles to be transported to the separating apparatus and for the separating apparatus to separate up-ended articles. The articles which are to be separated each stand on an edge. As a result, the force of gravity alone causes the articles to be aligned by way of the lower edges thereof. This facilitates the separating operation. This effect is obtained owing to the up-ending apparatus according to the solution.

In a preferred configuration, the up-ending apparatus executes an in-stream standing-up operation of the articles. The up-ending apparatus preferably has only an underfloor conveyor belt as the sole moving part and otherwise has positionally fixed components. This results in a low degree of wear, low energy consumption and low maintenance requirement.

In one configuration, an aligning apparatus is arranged downstream of the up-ending apparatus and upstream of the separating apparatus. The aligning apparatus aligns the flat articles on an edge, for example on the respectively longest edge. The aligned articles reach the separating apparatus. This configuration improves the separating operation because the articles which reach the separating apparatus are articles which have not only been up-ended but have been additionally aligned.

The format-splitting device preferably contains a feed transport path, a distributing guide and one removal transport path per subsequent processing device. This configuration causes a smaller mechanical loading than a format-splitting device with a drum or with slots. In addition, it is possible to transport the articles in a permanently clamped manner and thus to determine the respective stopping location of each article. A distance which has already been produced between the articles is maintained. A sequence of articles is maintained. This configuration and these effects are made possible because the format-splitting device is arranged downstream of the separating apparatus.

In one configuration, the separating apparatus contains at least two separators operating in parallel. A stream of articles reaching the separating apparatus is divided into one individual stream per separator. This division can be carried out, for example, in such a manner that each individual stream contains the same amount of articles, for example by, if there are two parallel separators, the first, the third, the fifth, etc. articles being conducted into the first individual stream and the second, fourth, sixth, etc. articles being conducted into the second individual stream. The parallel processing by use of two parallel separators increases the throughput. The articles do not have to be split according to format classes before the articles reach the separating apparatus.

Other features which are considered as characteristic for the invention are set forth in the appended claims.

Although the invention is illustrated and described herein as embodied in an apparatus and a method for processing articles of different dimensions, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the exemplary embodiment, the apparatus according to the solution and the method according to the solution are used to process flat mail items (standard letters, large letters, postcards, catalogs, . . . ).

The mail items are processed by a sorting installation with the aim of sorting the mail items as a function of the respective delivery address thereof. For this purpose, the delivery address of each mail item has to be deciphered and the mail item transferred as a function of the delivery address into a final sorting station of the sorting installation. The apparatus according to the solution in the exemplary embodiment is used in order to separate, align and orient the mail items in such a manner that the steps below can be carried out.

At the beginning of the processing operation, the flat articles are tipped onto an endless conveyor belt of a feed device. The endless conveyor belt is referred to below as the "feed conveyor belt". The feed conveyor belt is guided around at least two rollers. The rollers are mounted on horizontal shafts. At least one shaft is rotated, as a result of which the feed conveyor belt rotates in a transport direction. The feed conveyor belt is thus capable of transporting articles in the transport direction in a horizontal conveying plane. The other rollers are configured as running rollers.

Figure 1:
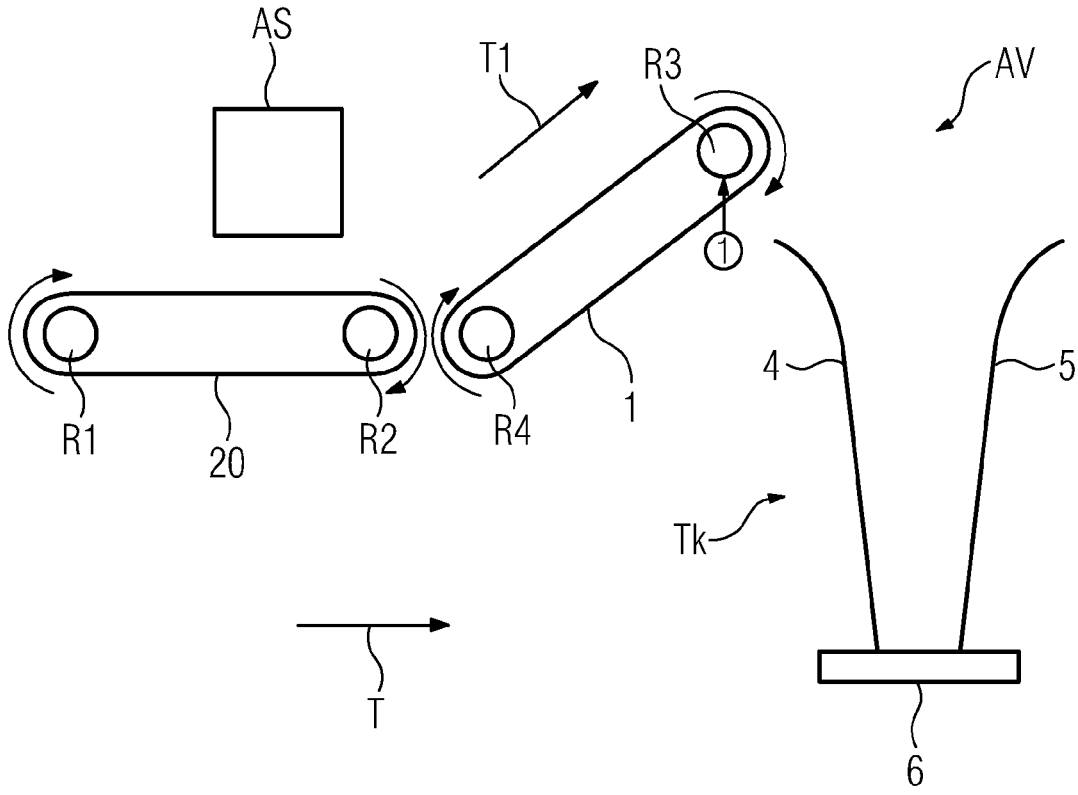
FIG. 1 is a diagrammatic, side view of an embodiment of an up-ending apparatus with a "waterfall"

FIG. 1 shows schematically an embodiment from the side. The feed conveyor belt 20, which is guided around the two rollers R1 and R2, an oblique conveyor belt 1 and a transport channel Tk are illustrated. The feed conveyor belt 20 transports mail items in the transport direction T. The flat mail items which lie in a random arrangement on the feed conveyor belt 20 are transported to a sorting station AS. In the sorting station AS, the articles which cannot be processed mechanically are discarded from the stream of mail items. In the exemplary embodiment, the articles are discarded by being taken from the feed conveyor belt 20. A worker or an automatic handling machine can undertake this discarding operation.

The articles to be discarded include articles which are not mail items and nevertheless pass onto the feed conveyor belt, for example because the articles have been thrown into a mailbox, damaged mail items, and mail items which, because of the dimensions thereof, cannot be mechanically processed by the processing devices present.

The feed conveyor belt 20 transports all of the remaining mail items to an up-ending apparatus AV. The up-ending apparatus AV transports the mail items in a transport direction T and, in the embodiments described below, brings about an in-stream standing-up operation.

In one embodiment, the up-ending apparatus AV contains a plurality of up-ending steps which are connected in series. Each up-ending step contains a respective surface. Each surface of an up-ending step is inclined about a horizontal axis of rotation. The horizontal axis of rotation runs parallel to the transport direction. Each surface is inclined in relation to the horizontal in such a manner that the angle of inclination of the surface of an up-ending step is greater than the angle of inclination of the preceding surface.

The mail items are transported successively over the surfaces of the up-ending steps. Because of the increasing angles of inclination of the surfaces, the transport over the cascade of surfaces of the up-ending steps connected in series has the effect of the mail items being up-ended step by step.

In one embodiment, each up-ending step additionally has a stop edge which is arranged at the lower end of the downwardly inclined surface. The mail items slide down the oblique surface and strike with an edge against the stop edge.

In another embodiment, an underfloor conveyor belt with a horizontal conveying plane is located below the up-ending apparatus. The mail items slide down the surface of each up-ending step and strike by the respective lower edge thereof against the underfloor conveyor belt. The underfloor conveyor belt transports the mail items from up-ending step to up-ending step.

The up-ending steps are arranged relative to one another in such a manner that each mail item can be transported from up-ending step to up-ending step in the transport direction without being obstructed by a surface from being transported further. In one embodiment, the up-ending steps are arranged in such a manner that two consecutive surfaces of the up-ending steps partially overlap. In another embodiment, two consecutive surfaces do not overlap.

In one configuration, the surfaces are formed by positionally fixed plates, and the mail items are stood up passively by the plates. The mail items are first of all transported by the feed conveyor belt 20 and the underfloor conveyor belt 14, and in addition by the kinetic energy imparted to the mail items by the feed conveyor belt. This configuration requires minimal outlay on apparatus. Since the underfloor conveyor belt 14 is the sole element of the up-ending apparatus AV that moves, the wear, the maintenance requirement and also the energy consumption turn out to be very low.

Figure 2:
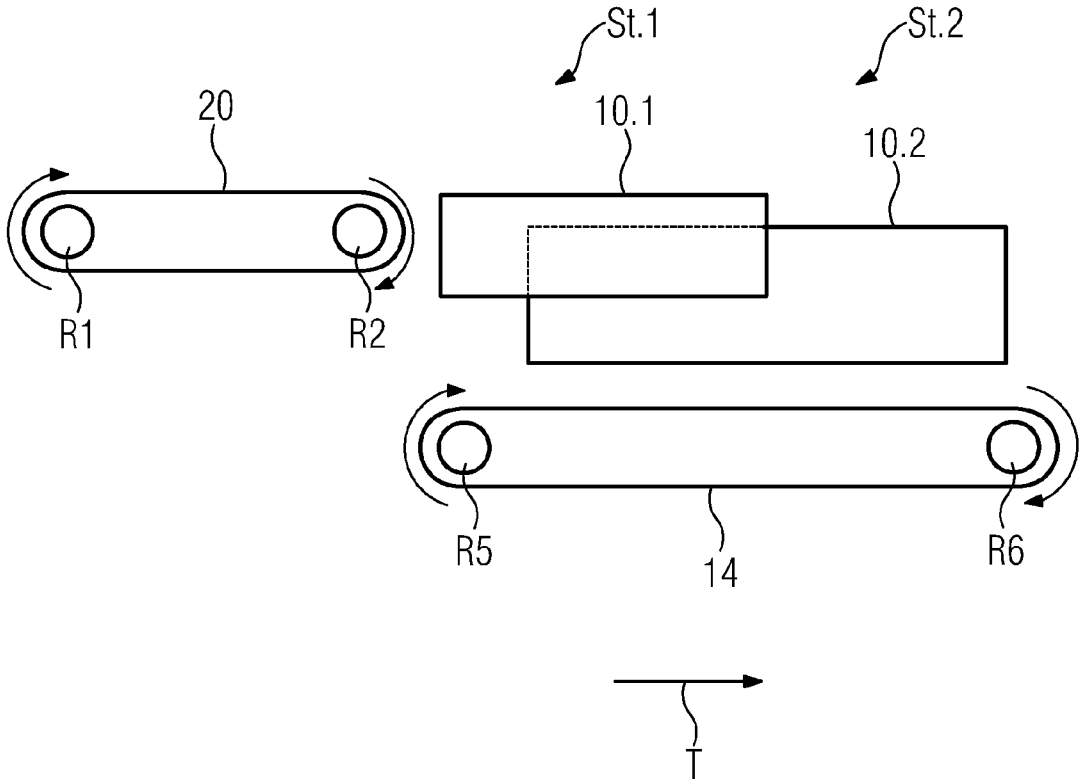
FIG. 2 is a diagrammatic, side view of an embodiment of the up-ending apparatus with two up-ending steps and one up-ending plate per up-ending step.
Figure 3:
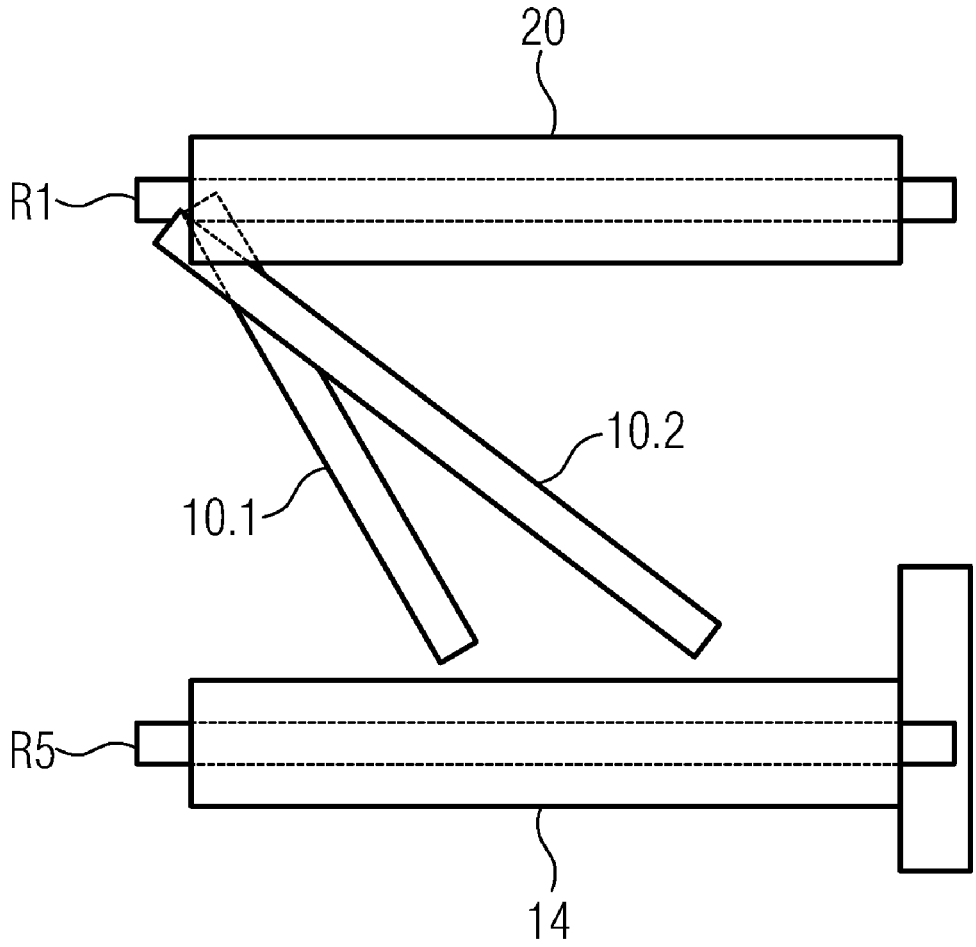
FIG. 3 is a diagrammatic, front view of the embodiment shown in FIG. 2.

FIGS. 2 and 3 show by way of example an embodiment with two up-ending steps St.1, St.2 and one positionally fixed plate per up-ending step. A horizontal underfloor conveyor belt 14 which is guided around two rollers R5, R6 is located below the two up-ending steps St.1, St.2. The mail items are first of all transported away over the first up-ending step St.1 and then over the second up-ending step St.2. The first up-ending step St.1 has a positionally fixed plate 10.1. The second up-ending step St.2 has a positionally fixed plate 10.2. The plate 10.1 is located upstream of the plate 10.2, as seen in the viewing direction of FIG. 3, which is perpendicular to the transport direction T. The mail items slide over the plates 10.1, 10.2 onto the underfloor conveyor belt 14. The transport direction T is perpendicular to the plane of projection of FIG. 3.

In an alternative configuration, the surfaces of the up-ending steps St.1, St.2 are likewise formed by driven endless conveyor belts, to be precise by one endless conveyor belt per up-ending step. Each endless conveyor belt is guided around in each case two rollers which sit on two shafts which are inclined in relation to the horizontal and are parallel to each other. The conveyor belts of the up-ending steps are referred to as "up-ending conveyor belts".

Figure 4:
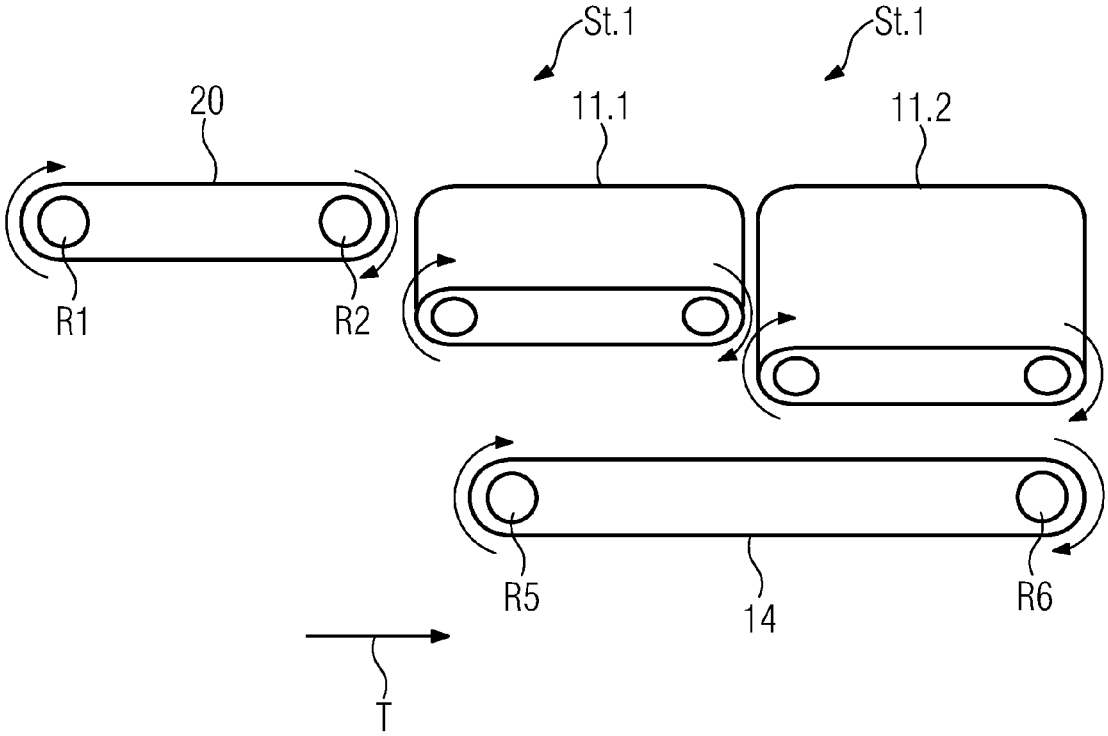
FIG. 4 is a diagrammatic, side view of an embodiment of the up-ending apparatus with two up-ending steps and one up-ending conveyor belt per up-ending step.

FIG. 4 shows by way of example this alternative configuration, likewise with two up-ending steps St.1, St.2. The first up-ending step St.1 has an obliquely arranged up-ending conveyor belt 11.1, and the second up-ending step St.2 has an obliquely arranged up-ending conveyor belt 11.2. The up-ending conveyor belts 11.1, 11.2 are adjacent to each other, and therefore mail items pass from the conveyor belt 11.1 onto the subsequent conveyor belt 11.2.

In another configuration, the up-ending apparatus AV has an up-ending conveyor belt which is rotated per se, preferably instead of the up-ending steps St.1, St.2. The rotated up-ending conveyor belt is likewise an endless conveyor belt which is guided around two rollers. The two rollers each sit on a shaft. The shaft which is adjacent to the feed device is mounted horizontally. The other shaft which is adjacent to the subsequent separating apparatus is arranged vertically. As a result, the up-ending conveyor belt is rotated per se.

Figure 5:
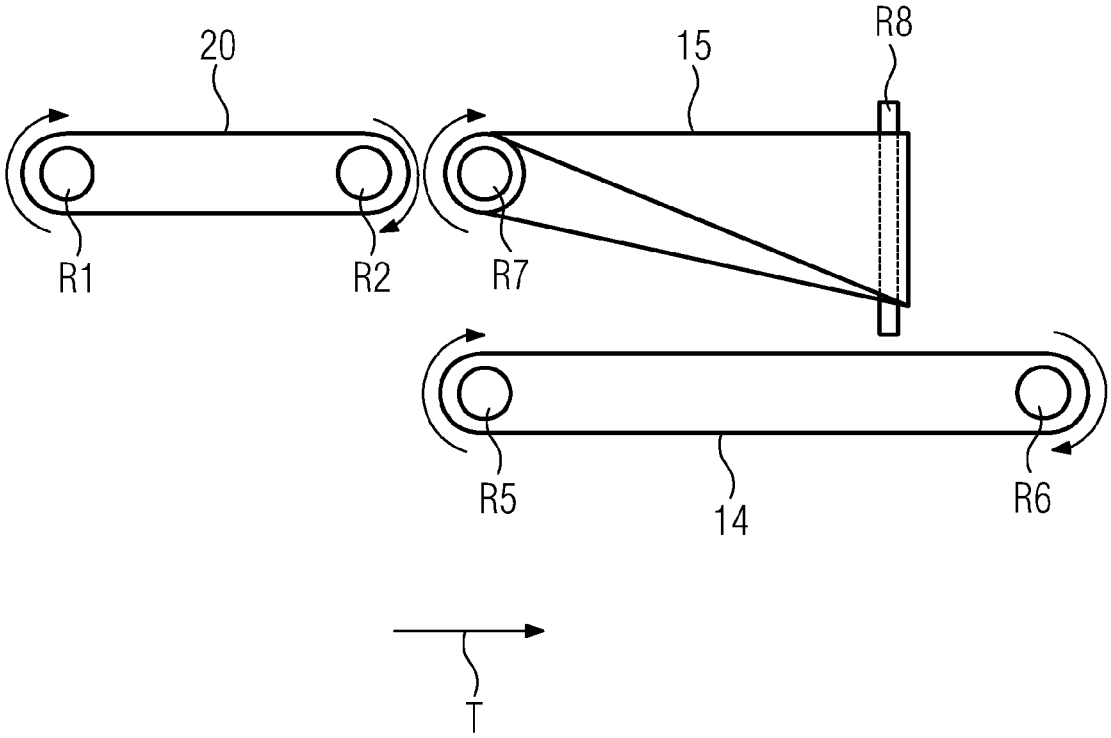
FIG. 5 is a diagrammatic, side view of an embodiment of the up-ending apparatus with a conveyor belt which is curved per se.

FIG. 5 shows this configuration from the side. The feed conveyor belt 20, the underfloor conveyor belt 14 and the up-ending conveyor belt 15 which is rotated per se are illustrated. The underfloor conveyor belt 14 begins behind the center of the up-ending conveyor belt 15, as seen in the transport direction T. The up-ending conveyor belt 15 is guided around the horizontal roller R7 and around the vertical roller R8. Preferably, the vertical roller R8 is driven and the horizontal roller R7 is positioned as a running roller.

In a further embodiment, the up-ending apparatus AV contains a horizontal or preferably oblique endless conveyor belt and a "waterfall". FIG. 1 shows the oblique endless conveyor belt 1.

The oblique endless conveyor belt 1 adjoins the feed conveyor belt 20. The oblique endless conveyor belt 1 transports mail items, which are lying on the oblique conveyor belt 1, obliquely upward on an oblique track. The oblique endless conveyor belt 1 is guided about an upper roller R3 and about a lower roller R4. The upper roller R3 sits on a horizontal and preferably driven shaft. The mail items lying on the oblique endless conveyor belt 1 are guided about the upper roller R3 and drop off an edge 4 of the waterfall.

In the exemplary embodiment, the mail items subsequently run through a U-shaped transport channel Tk with two side walls 4, 5 and with a further underfloor conveyor belt 6 as the base. This applies both if the up-ending apparatus has a plurality of up-ending steps and if the up-ending apparatus contains a waterfall.

The underfloor conveyor belt 6 may be the same as the underfloor conveyor belt 14 of the up-ending apparatus, i.e. the underfloor conveyor belt 6=14 extends over the entire length of the up-ending apparatus AV and of the transport channel Tk. Of course, the continuous underfloor conveyor belt 6=14 can be used only if the up-ending apparatus AV and the transport channel Tk transport mail items in the same transport direction T.

In another configuration, the up-ending apparatus AV and the transport channel Tk have a respectively dedicated underfloor conveyor belt 14 and 6.

The distance between the side walls 4, 5 of the transport channel Tk is preferably of a size such that mail items do not become jammed during transport and bear loosely against one of the side walls 4, 5. This embodiment saves the necessity of also providing the side walls 4, 5 with a conveying device. In addition, this configuration has the effect that the mail items are aligned by way of the lower edges thereof. The U-shaped transport channel Tk transports the up-ended mail items. This applies both in the embodiment with the up-ending steps and in the embodiment with the waterfall. This is because the force of gravity presses the mail items onto the horizontal underfloor conveyor belt 6.

In the configuration with the up-ending steps St.1, St.2, which have oblique surfaces, the feed conveyor belt 20, the up-ending steps St.1, St.2 and the transport channel Tk are arranged one behind another preferably in a line such that the feed conveyor belt 20, the up-ending steps St.1, St.2 and the transport channel Tk transport the mail items all in the same transport direction T.

By contrast, in the configuration with the waterfall (edge 4), the transport channel Tk transports the mail items away in a transport direction T2 which is perpendicular to the transport direction T1 in which the oblique endless conveyor belt 1 transports the mail items up the oblique track. The transport direction T2 is perpendicular to the plane of projection of FIG. 1 and perpendicular to the transport direction T of the up-ending apparatus AV.

The mail items drop off the edge 4 onto the underfloor conveyor belt 3 of the transport channel Tk and are transported away by the underfloor conveyor belt 3 in a transport direction T2 parallel to the article planes. The distance between the side walls 4, 5 of the transport channel Tk is smaller than the smallest dimension of a mail item in the article plane. This avoids a mail item lying flat on the underfloor conveyor belt 6 of the transport channel Tk and no longer being up-ended.

Figure 6:
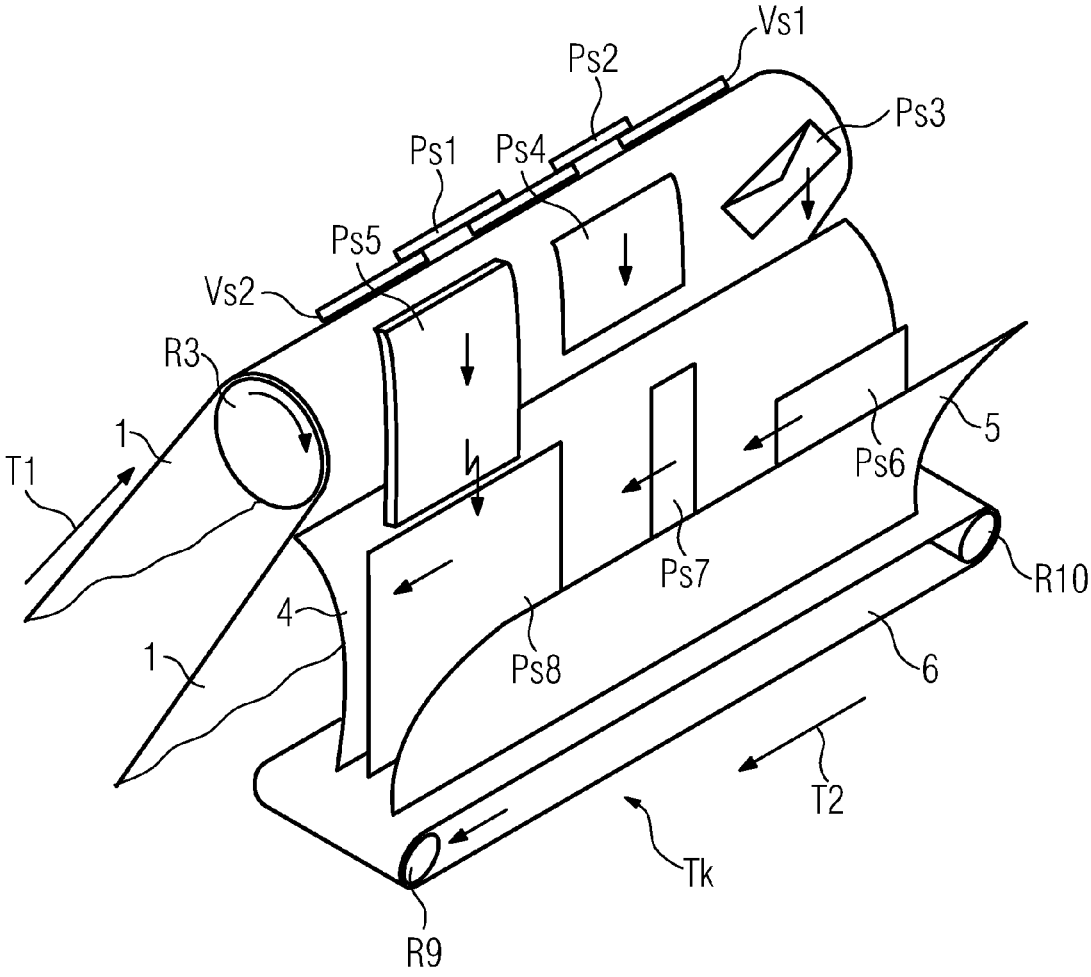
FIG. 6 is a diagrammatic, perspective view of the waterfall from FIG. 1 and a transport channel.

FIG. 6 shows, schematically and in a perspective illustration, the waterfall with the edge 4, the further side wall 5 and the underfloor conveyor belt 6. Three mail items Ps3, Ps4, Ps5 are just dropping down the edge 4. Two further mail items Ps1, Ps2 are just being transported by the oblique endless conveyor belt 1 up the oblique track in the transport direction T1. The underfloor conveyor belt 6 of the transport channel Tk is just transporting away three mail items Ps6, Ps7, Ps8 in the transport direction T2. The side walls 4, 5 of the transport channel Tk are formed by positionally fixed, curved plates with smooth surfaces.

After the up-ending operation, each mail item does indeed stand on an edge and is aligned approximately vertically. However, the edge may be a longitudinal edge or a transverse edge. A mail item is typically rectangular, not square, and therefore has two left edges and two transverse edges which are shorter than the longitudinal edges. However, it is desirable for all of the mail items to stand on the longitudinal edges thereof before the mail items reach the following separating device VV. Therefore, each up-ended mail item now passes through an aligning apparatus AusV which rotates a mail item if it is standing on a transverse edge such that, after rotation, the mail item is standing on a longitudinal edge while the aligning apparatus AusV leaves a mail item which is already standing on the longitudinal edge in the position. The rotation is a rotation about an axis of rotation which is perpendicular to the article plane.

In one refinement, the aligning apparatus AusV has a shaking section over which the mail items are conducted. The shaking section has a plurality of parallel rollers with eccentric elements. The mail items are guided over the rollers and at the same time are laterally supported, as a result of which the upright mail items are rotated.

Figure 9:
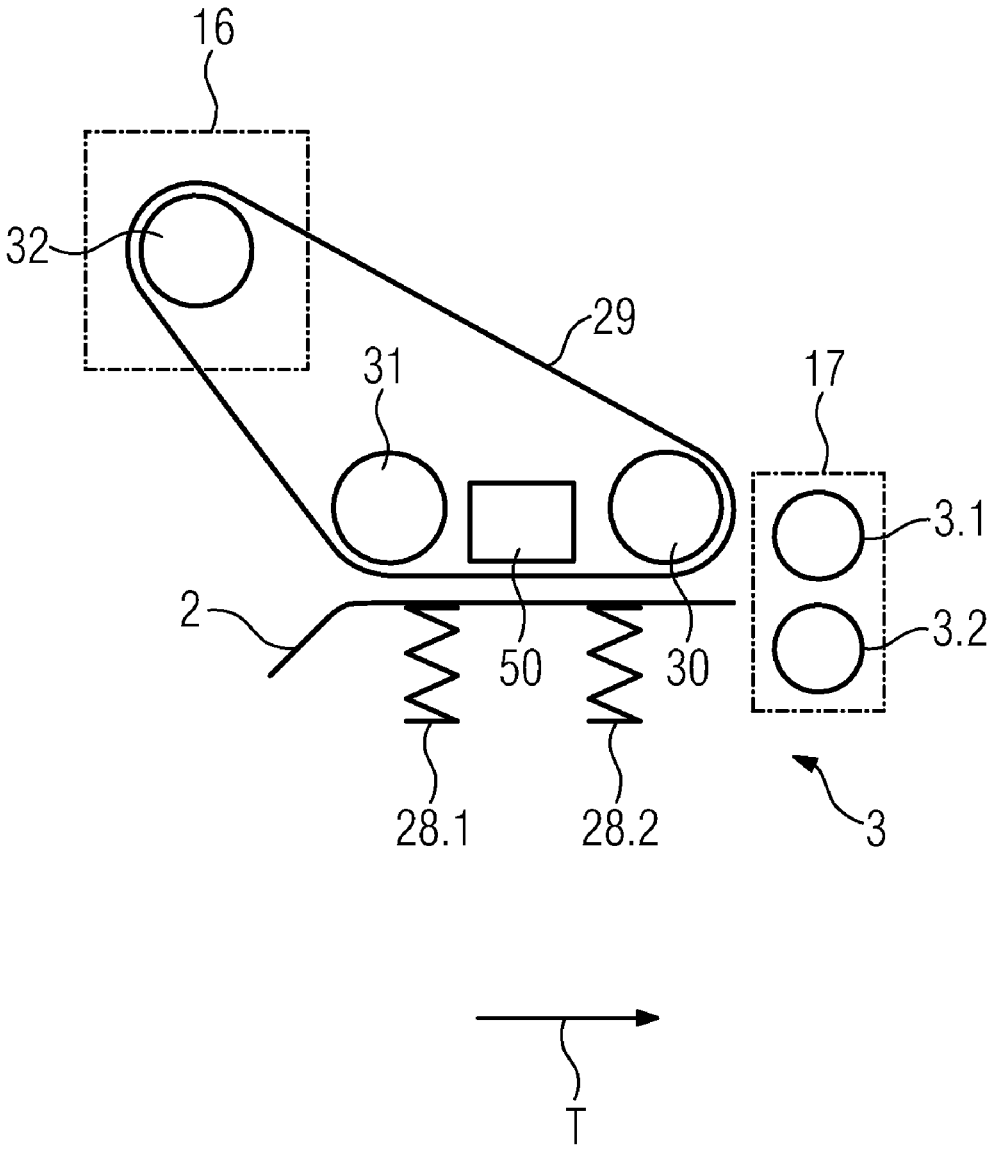
FIG. 9 is a diagrammatic, top plan view of separator with a transport element and a restraining element.

FIG. 9 shows a different configuration of the aligning apparatus AusV.

In this different configuration, the aligning apparatus AusV has a downwardly inclined endless conveyor belt Fb-down and an endless conveyor belt Fb-up leading upward. The downward conveyor belt Fb-down is arranged obliquely above and upstream of the conveyor belt Fb-up leading upward in such a manner that a step St occurs between the downward conveyor belt Fb-down and the conveyor belt Fb-up leading upward. The downward conveyor belt Fb-down preferably has an angle of inclination of at most 20° and the conveyor belt leading upward has a smaller angle of inclination.

Each mail item first of all passes along the downward conveyor belt Fb-down, then drops down the step St and is subsequently transported by the conveyor belt Fb-up leading upward. During the transition from the downward conveyor belt Fb-down to the conveyor belt Fb-up leading upward, the mail item receives a push and endeavors to pass into a position of minimum entropy. However, this is precisely the position on the longitudinal edge. A mail item is again prevented from tipping over laterally.

In the exemplary embodiment, the mail items subsequently reach a buffer device PE. The buffer device PE brings about uniform feeding of mail items to the subsequent separating apparatus VV. The buffer device PE is preferably likewise configured as a transport channel with an underfloor conveyor belt.

The minimum and maximum feed rates of mail items to the separating apparatus VV are specified. The buffer device PE has a feed-measuring device. The feed-measuring device measures a parameter, which depends on the actual feed rate of mail items to the buffer device PE, at specified measuring times. For example, at each measuring time, the measuring device measures the thickness of the mail item or the overall thickness of a plurality of overlapping mail items which reach the buffer device PE. For example, the stream of upright mail items deflects a roller or a movable side wall perpendicularly to the transport direction T. The further the roller or movable side wall is deflected, the thicker is the stack of mail items being transported at this moment into the buffer device PE. The time history of the deflection is a measure of the feed rate into the buffer device PE.

As an alternative, the feed-measuring device has a camera and evaluates an image of the mail items fed in order to count how many mail items are just reaching the buffer device PE at the measuring time.

The minimum feed rate determines a lower limit for the measured value of the parameter. The maximum feed rate correspondingly determines an upper limit. If the feed-measuring device measures a parameter value which lies above the upper limit, the feed of further mail items to the buffer device DE is reduced, for example by the conveying speed of the underfloor conveyor belt 14 of the transport channel Tk being reduced, which lowers the feed rate. If the feed-measuring device measures a parameter value which lies below the lower limit, the feed rate is correspondingly increased. The control just described of the feed of mail items to the buffer device PE has the effect that the feed rate of mail items to the separating apparatus VV always lies between the lower and the upper limit.

This is also achieved in that the feed-measuring device makes the measurement at the entrance to the buffer device, and the mail items are then still transported through the buffer device PE and along a further transport route before they reach the separating apparatus VV, this also requiring time.

The mail items now reach the separating apparatus VV standing up, to be precise, in the exemplary embodiment, by the mail items being transported in a transport direction parallel to the article planes thereof. The separating apparatus VV produces a stream of upright and spaced-apart mail items. In one configuration, the same gap occurs between two consecutive mail items, even if the mail items vary in length. The stream of mail items leaves the separating apparatus.

The separating apparatus VV contains at least one separator. In the exemplary embodiment, the or each separator in each case has a driven transport element, a non-driven restraining element, and a driven advancing element.

The transport element has, for example, a plurality of endless conveyor belts which are arranged one above the other and are guided about a plurality of vertical rollers. The restraining element has, for example, a plurality of restraining components lying one above another. The transport element moves at a relative speed to the restraining element, for example because the restraining element consists only of positionally fixed components. The frictional force between the transport element and a mail item is greater than the frictional force between the restraining element and the mail item, and the frictional force is in turn greater than the frictional force between a plurality of mail items adhering to one another. As a result, the transport element and the restraining element have the effect of pulling apart two overlapping mail items.

A suction chamber preferably sucks in air and generates a negative pressure. The negative pressure sucks mail items onto the transport element and increases the frictional force.

The advancing element consists, for example, of two driven transport rollers which rotate in an opposed direction of rotation and at the same speed. As soon as the front edge of a mail item reaches the advancing element, the advancing element grasps the mail item, for example by the transport rollers gripping the mail item therebetween. The transport element and the restraining element are stopped and hold back a further mail item which partially overlaps the first mail item. The advancing element advances the mail item running on ahead out of the gap between the transport element and the restraining element. As soon as this operation has finished and the rear edge has passed the advancing element, the transport element is started again. The separator therefore operates in a start-stop mode.

FIG. 9 shows schematically, in top view, a separator of the separating apparatus VV. The figure illustrates:

the transport element 29 which contains a plurality of endless conveyor belts arranged vertically one above another, three rollers 30, 31, 32 about which the endless conveyor belts of the transport element 29 are guided, a driving motor 16 for the roller 32, an advancing element 3 with two transport rollers 3.1, 3.2, a suction chamber 30, a positionally fixed restraining element 2, and two compression springs 28.1, 28.2 which press the restraining element 2 onto the transport element 29.

The roller 32 is driven. The two remaining rollers 30, 31 are configured as running rollers.

In one configuration, the separating apparatus VV has two separators connected in series. The subsequent, second separator separates those mail items which the preceding, first separator has not separated.

For example, the second separator has a double draw-off detection device which checks whether an item being transported through the second separator consists of a single mail item or of a plurality of overlapping mail items. The subsequent, second separator then preferably operates in the start-stop mode only if the double draw-off detection device in the second separator has detected a plurality of articles which partially overlap.

In a different configuration, the separating apparatus VV has two separators connected in parallel. The two parallel separators are preferably constructed in the same manner, and each separator is capable of separating the same format classes, of which there are at least two. The throughput through the separating apparatus VV is doubled by two parallel separators being used. It is not required to separate the mail items in accordance with the formats thereof before the mail items reach the parallel separators. A stream of upright and spaced-apart mail items leaves each separator.

By two identical separators being connected in parallel, a throughput which is twice as large as with a single separator can be obtained.

In order that the two separators can operate in parallel, the stream of mail items which are transported upright to the separating apparatus VV is sorted into two streams which are transported in parallel to a respective separator. In one configuration, a splitting element in the form of a directional buffer is located in the transport channel Tk. The splitting element sorts the stream of mail items into two streams. The splitting element is arranged in such a manner that the splitting element divides the dropping mail items into two streams having approximately the same amount of mail items.

In the embodiment with the waterfall (edge 4), the splitting element is preferably located at that point in the transport channel Tk at which the mail items drop down the edge 4 and strike against the underfloor conveyor belt 6. The splitting element separates the stream of dropping mail items into two parallel streams. The mail items do not already have to be split at this point according to the formats thereof.

Figure 7:
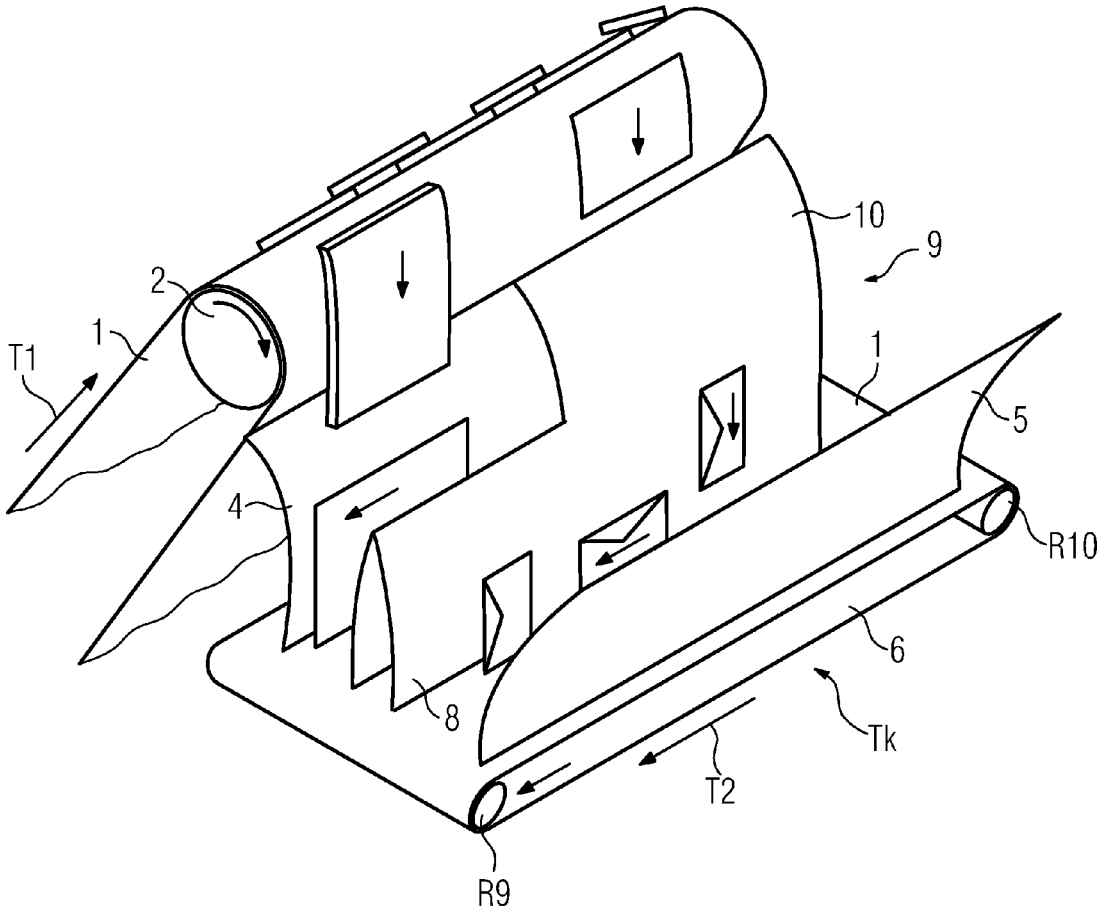
FIG. 7 is a diagrammatic, perspective view as in FIG. 6 with an additional splitting plate.
Figure 8:
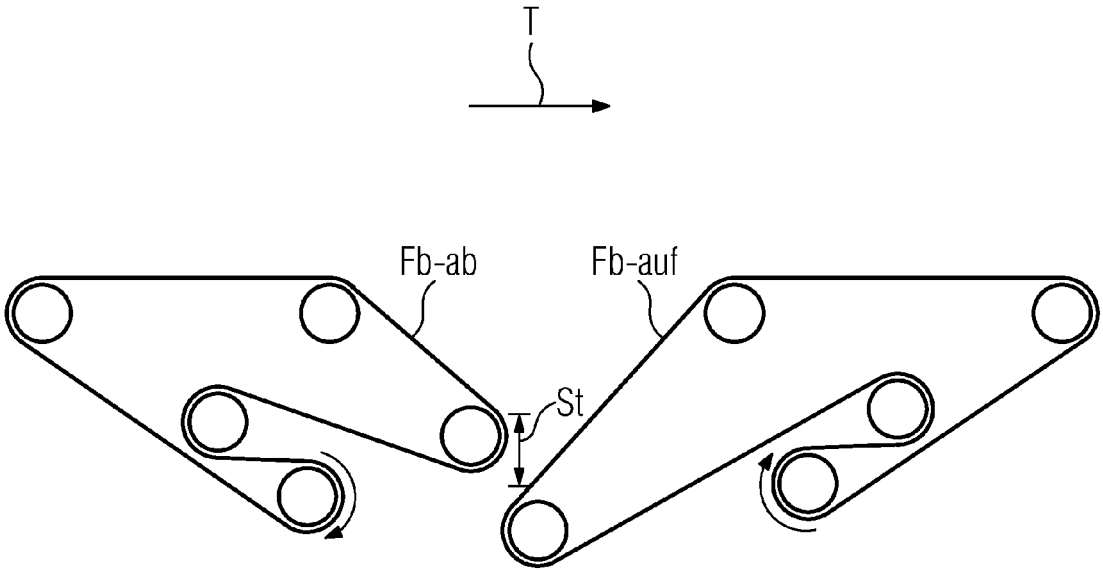
FIG. 8 is an illustration of a configuration of an aligning apparatus.

FIG. 7 shows by way of example a transport channel Tk with a dividing partition 12 of this type. Upon dropping down, each mail item lands either between the side wall 4 and the partition 12 or between the side wall 5 and the partition 12.

The stream of spaced-apart mail items is transported to a format-measuring device FM. The format-measuring device FM measures approximately the dimension of each mail item. Since the format-measuring device is arranged downstream of the separating apparatus VV, separated mail items reach the format-measuring device FM. As a result, the measuring of the mail items is significantly simpler and is less error-prone than if the format-measuring device FM were arranged upstream of the separating apparatus VV.

In one embodiment, the format-measuring device FM contains two cameras. One camera generates at least one first image of a mail item from a first imaging direction. The first imaging direction is perpendicular to the article plane of the mail item, i.e. also perpendicular to the transport direction T in which the mail item is being transported. The length and the height of the mail item are measured by evaluation of the first image. The other camera produces at least one second image of the mail item from a second imaging direction which is perpendicular to the first imaging direction and to the transport direction T and lies in the article plane. By evaluation of the second image, the thickness of the mail item is measured.

An underfloor conveyor belt of the format-measuring device FM transports the mail items past the cameras. Side walls support the up-ended mail items. It is also possible for two endless conveyor belts in each case to temporarily clamp a mail item therebetween.

A different configuration dispenses with the first camera which produces images from an imaging direction perpendicular to the transport direction T. The length and the height of each mail item are measured instead with the aid of light barriers. Each light barrier has a transmitter and a receiver. The transmitter emits a light beam which either strikes the receiver or is interrupted by a mail item because the mail item is located between the transmitter and receiver.

A plurality of light barriers are preferably fitted one above another. Each mail item transported upright interrupts at least the light beam of the lowermost light barrier. The transport speed of the mail item is controlled or measured and is therefore known. It is also measured for how long a mail item interrupts the light beam from the lowermost light barrier. The product of the transport speed and the measured duration of the interruption supplies the length of the mail item. The height of the mail item lies between the height at which the highest light barrier which is interrupted is fitted and the height at which the lowermost light barrier which is not interrupted is arranged. The light barriers are arranged in such a manner that the height regions, which can differ, are sufficient in order to determine the respective format class of the mail item.

At least two format classes are specified, for example the format class of standard letters (for example up to DIN C5 or "US letters") and the format class of large letters (for example greater than DIN C5 or "US flats"). An evaluation and control unit evaluates the at least two images of each mail item and decides automatically and as a function of the dimensions measured as to which format class each mail item belongs.

The separated and measured mail items are transported to a branching device Verzw. In the exemplary embodiment, the branching device Verzw acts together with the format-measuring device FM as the format-splitting device.

The U-shaped transport channel Tk opens into the branching device Verzw. At least one transport path per specified format class leads out of the branching device Verzw. Since the branching device Verzw divides up separated mail items into different formats, it can be realized by a simpler construction than if it did not have to split separated mail items according to format. There is a lower risk of a jam occurring due to mail items becoming jammed.

In the exemplary embodiment, the mail items are transported from the separating apparatus VV to the branching device Verzw without slipping. For example, two endless conveyor belts in each case temporarily clamp a mail item therebetween. The two endless conveyor belts ("cover belts", "pinch belts") are guided about a plurality of rollers. The rollers sit on vertical shafts, of which preferably one shaft per endless conveyor belt is driven in each case. Since no slip occurs and because the transport speed at which the mail item is transported to the branching device is measured or controlled, the evaluation and control unit "knows" when the mail item reaches which point in the branching device Verzw.

The branching device Verzw has a plurality of distributing guides. The evaluation and control unit activates the distributing guides in such a manner that each mail item is conducted into that transport path which is assigned to the format class of the mail item. For example, a main transport path leads through the branching device Verzw and is assigned to the format class for standard letters. A respective transport path which branches off from the main transport path in a distributing guide is provided for each other format class.

The transport path for a format class transports the mail items of the format class upright and spaced apart from one another to a processing device. The processing device is capable of processing mail items of the format class. For example, the processing device carries out at least some of the now described steps.

The mail items are stood up, for which purpose the step is included of orienting the mail items in such a manner that the surfaces with the delivery addresses all face the same side and the delivery addresses are shown upright.

Franking marks on the mail items are analyzed and canceled.

The mail items are weighed.

At least one image of the mail item is produced in such a manner that the image has a high resolution and shows a delivery address. The mail item is provided with the delivery address and is intended to be transported to the delivery address.

Two images which can be evaluated by computer of two sides of the upright mail item are preferably produced. By evaluation of the images, it is decided on which side of the mail item the delivery address is located and whether the delivery address is shown upright or upside down. If required, the mail item is rotated by a conveyor belt which is rotated per se and/or by a "head station". A "head station" of this type is disclosed, for example, in German patents DE 4315053 C2 and in DE 4345160 C2.

The respective delivery address on the mail items is deciphered. For this purpose, the image is evaluated by the region with the delivery address ("region of interest") being determined and the delivery address being deciphered. The deciphering result is automatically compared with entries in an address database in which current delivery addresses are stored.

A search is made for forwarding instructions ("endorsements") and mailman notes on the mail items and, if appropriate, these are evaluated.

Sorting information is printed onto the mail item, for example in the form of a barcode.

The mail item is transferred to a final sorting station as a function of the sorting information. For example, a respective stack of mail items is produced in each final sorting station.

In the exemplary embodiment, two format classes are differentiated. There is therefore a processing device VE-S for standard letters and a processing device VE-G for large letters.

Up to now, the configuration in which the mail items are divided up into the format classes directly after the separating operation has been described. Other configurations can likewise be realized.

In one configuration, the separated mail items are first of all oriented. A respective image which can be evaluated by computer is produced of each side of the upright mail item. By evaluation of the two images, it is decided on which side the delivery address is located and whether the delivery address is shown upright or upside down. A high resolution camera subsequently produces an image of each mail item showing the upright delivery address. The camera is configured in such a manner that the camera is capable of producing for each mail item an image with the delivery address no matter to which format class the mail item belongs.

The configuration of the further processing devices depends which processing device is arranged upstream and which processing device is arranged downstream of the format-splitting device FM, Verzw. For example, one pair of scales weighs only large letters, and is therefore arranged downstream of the format-splitting device FM, Verzw. The printers which cancel franking marks and print sorting information are arranged, for example, upstream of the format-splitting device.

In a different configuration, only standard letters are automatically sorted, whereas large letters are sorted by hand. The camera needs merely to be configured in order to produce a respective high-resolution image of each standard letter. The camera and further processing devices are arranged upstream of the format-splitting device. By contrast, the separated, up-ended and aligned large letters are conducted directly into special final sorting stations.

Figure 10A:
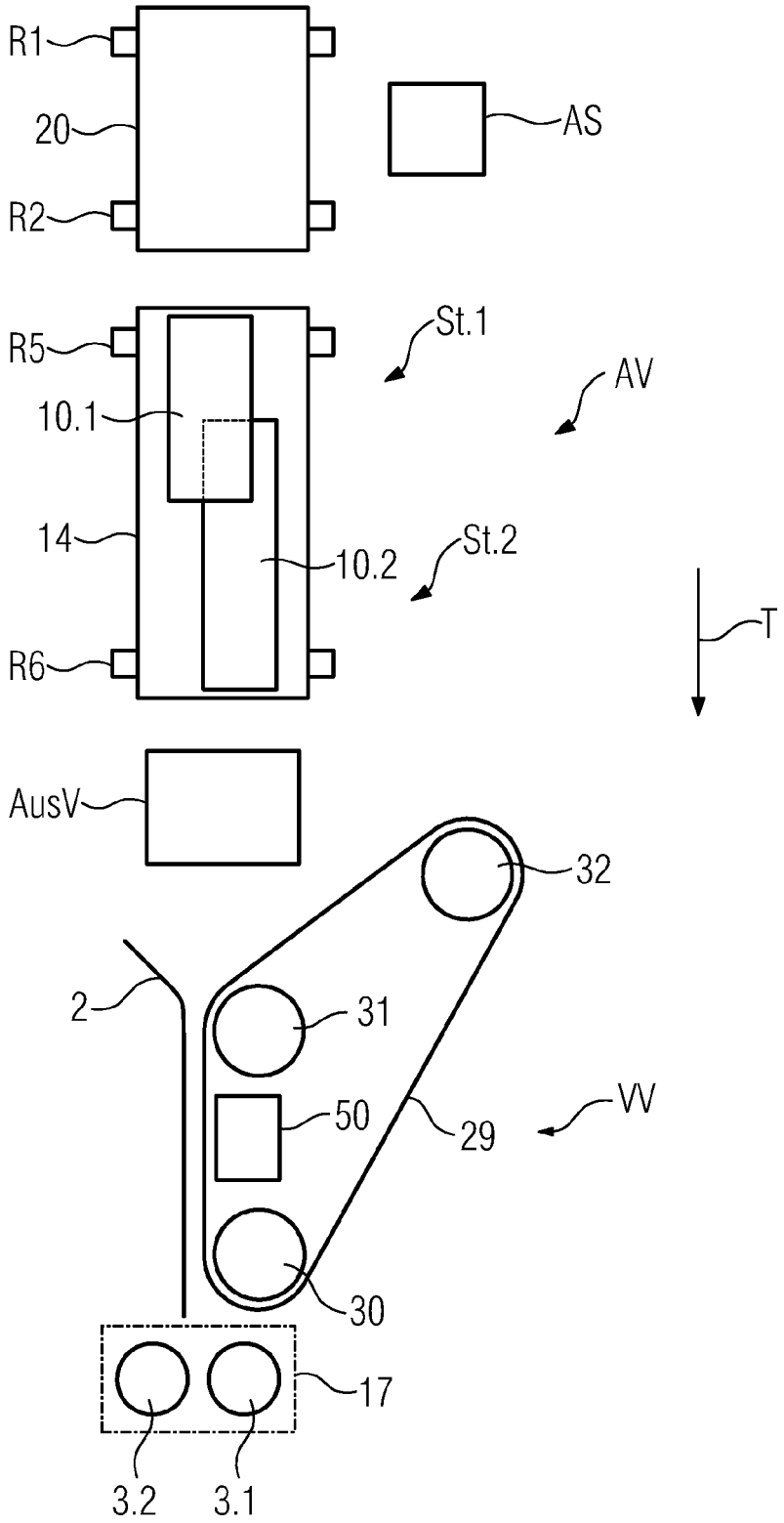
FIGS. 10A and 10B are diagrammatic, top plan views of the entire apparatus in the embodiment with the up-ending steps.
Figure 10B:
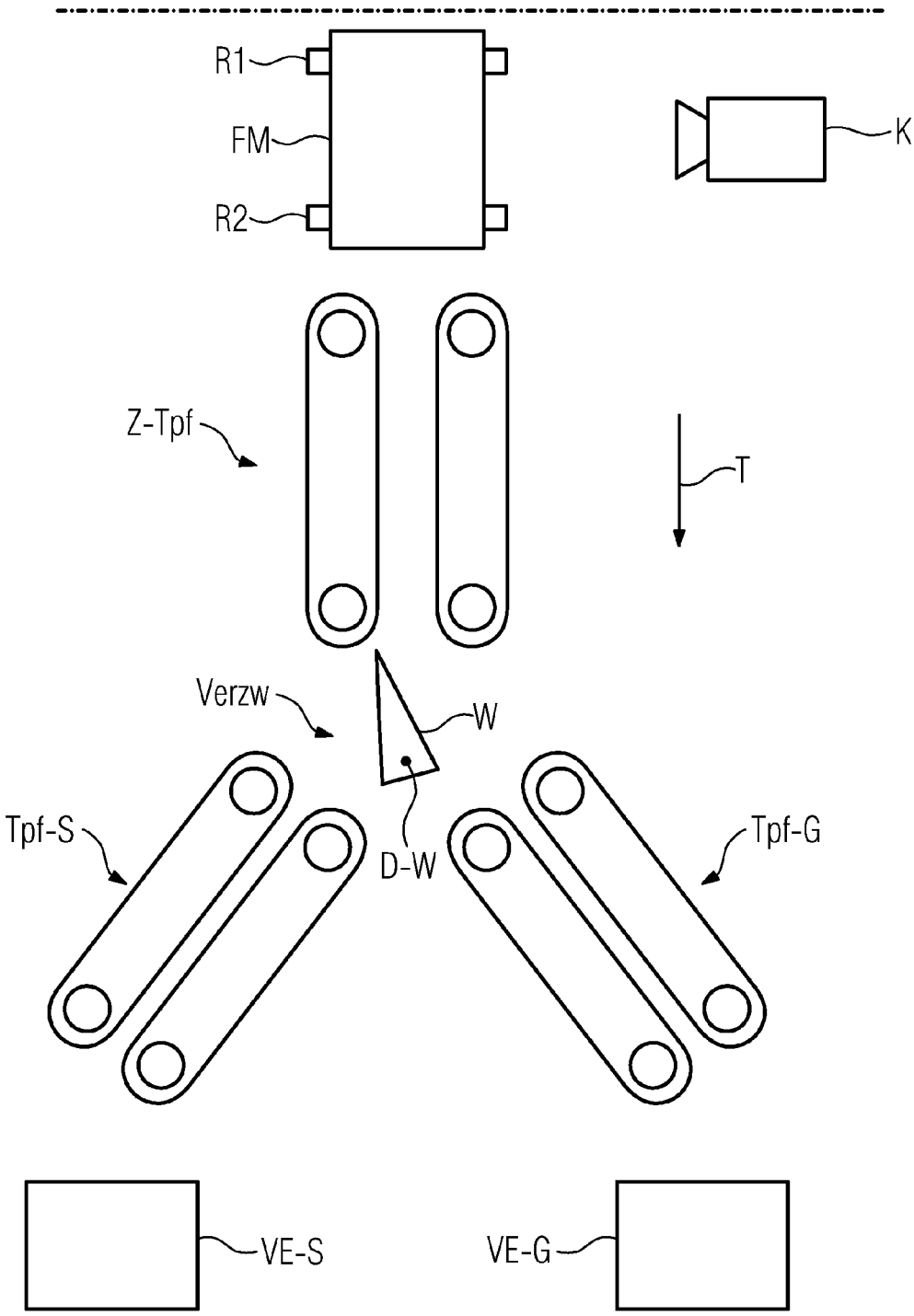
Figure 11A:
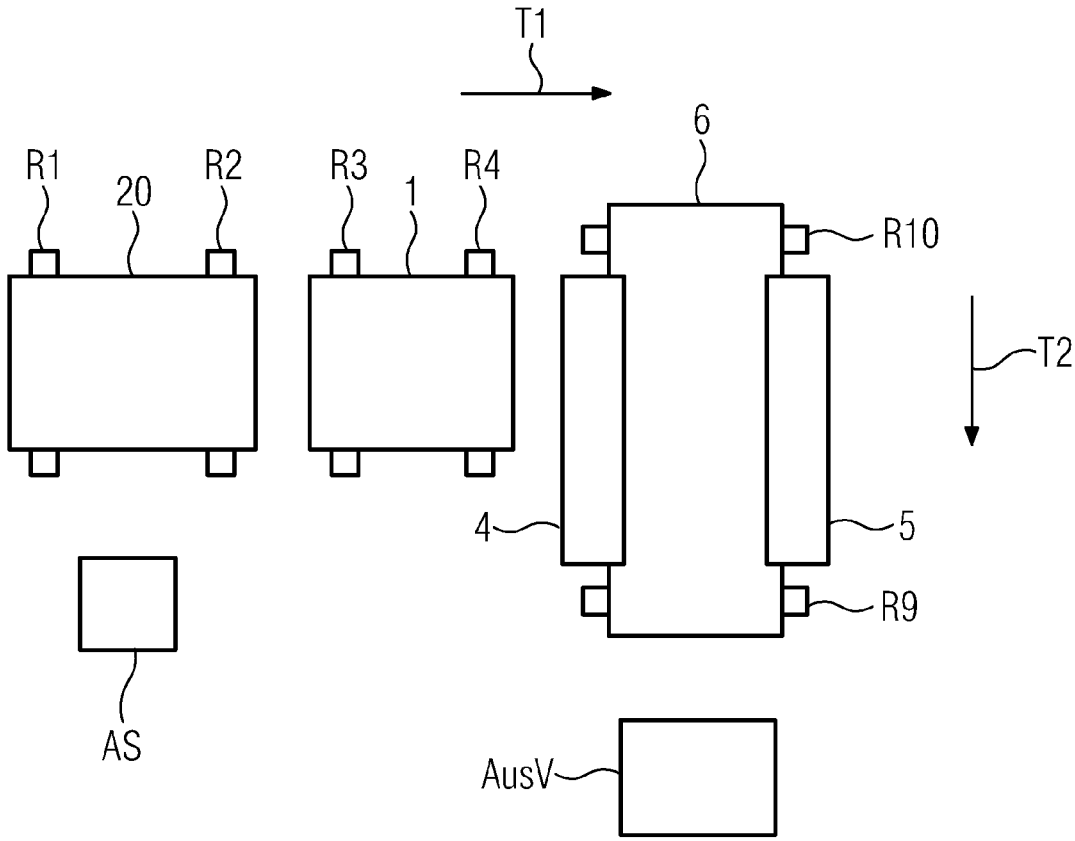
FIGS. 11A and 11B are diagrammatic, top plan views of the entire apparatus in the embodiment with the waterfall.
Figure 11A:
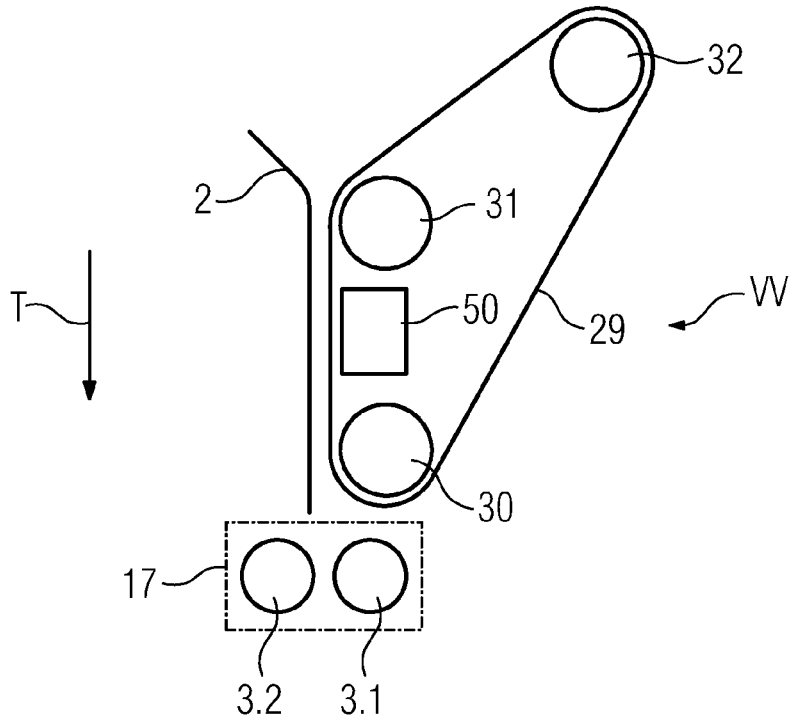
Figure 11B:
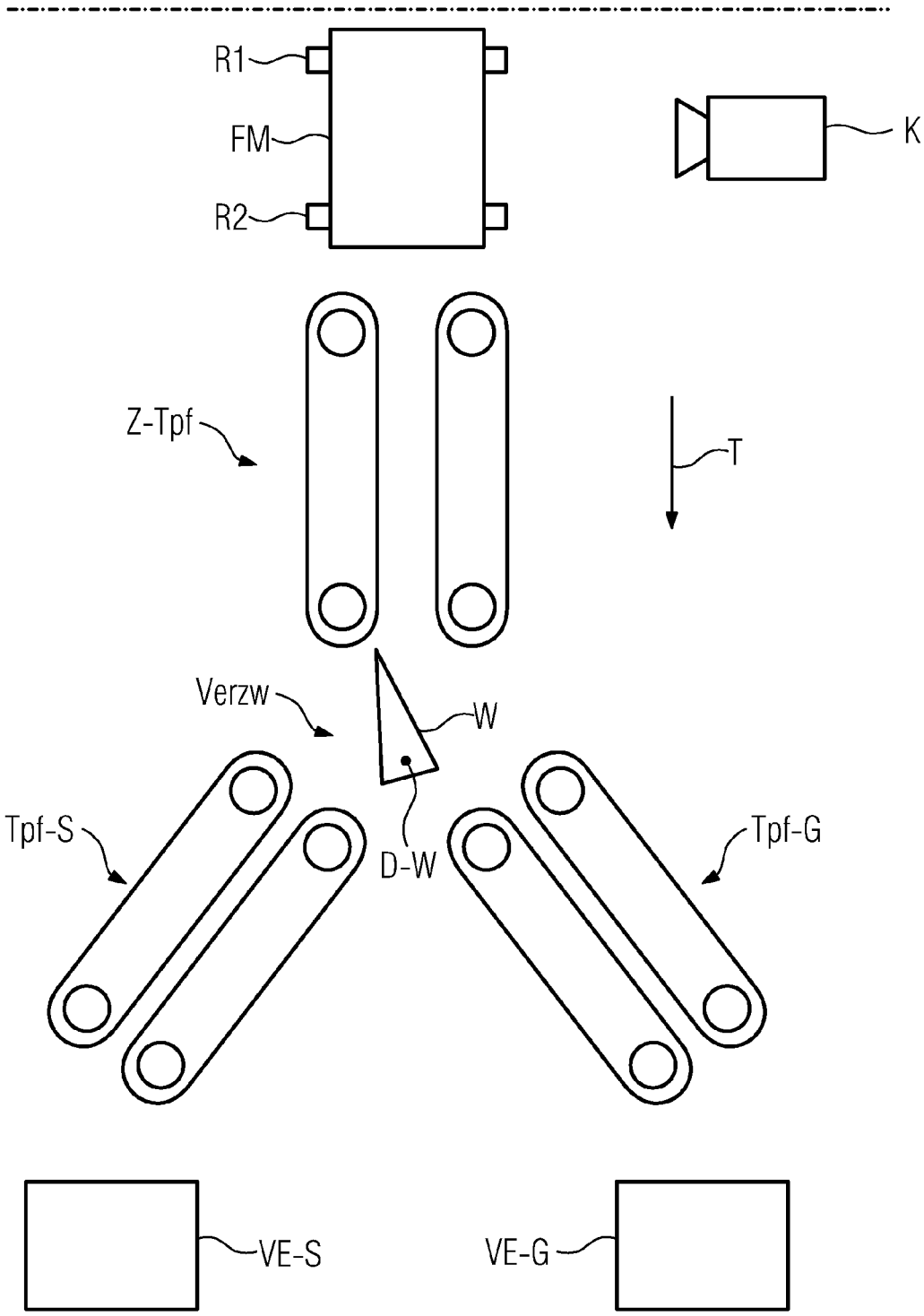

FIGS. 10A, 10B shows schematically all of the components of the apparatus according to the solution in the configuration with the up-ending steps. FIG. 11 shows schematically all of the components of the variant with the waterfall.

The designations in FIGS. 10A, 10B and FIGS. 11A, 11B correspond to the designations in the preceding figures. Furthermore, FIGS. 10A, 10B, 11A, 11B illustrate: a camera K of the format-measuring device FM, a distributing guide W of the branching device Verzw, a feed transport path Z-Tpf, a removal transport path Tpf-S which leads to the processing device VE-S for standard letters, and a further removal transport path Tpf-G which leads to the processing device VE-G for large letters.

The distributing guide W is mounted rotatably about an axis of rotation D-W.

The mail items are transported by the feed transport path Z-Tpf to the distributing guide W. The distributing guide W deflects each mail item either into the transport path Tpf-S or into the transport path Tpf-G. The transport path Tpf-S transports a mail item to the processing device VE-S for standard letters. The transport path Tpf-G transports a mail item to the processing device VE-G for large letters.

The invention claimed is:

1. A configuration for processing flat articles, wherein each flat article extends in an article plane and at least two format classes are specified, the configuration comprising:

a conveying device;

a separating apparatus;

a format-splitting device;

at least one processing device per specified format class, said processing device for a format class configured for processing the flat articles of the format class;

a conveyor track;

the configuration transporting the flat articles which have been tipped onto said conveying device along said conveyor track to said separating apparatus and from said separating apparatus to said format-splitting device;

said separating apparatus disposed in said conveyor track and upstream of said format-splitting device;

said separating apparatus configured to separate the flat articles and to transport the flat articles further such that a stream of upright, spaced-apart articles leaves said separating apparatus;

the configuration transporting separated flat articles from said separating apparatus to said format-splitting device;

said format-splitting device dividing the flat articles in dependence on dimensions of the flat articles into article classes such that all of the flat articles of a set of articles belong to a same format class;

the configuration transporting all of the flat articles of the set of articles in a form of a stream of upright, spaced-apart articles to said processing device configured to process the flat articles of the format class; and said processing device processing the flat articles transported thereto.

2. The configuration according to claim 1, further comprising an up-ending apparatus, said separating apparatus being disposed downstream of said up-ending apparatus, the configuration transporting the flat articles which have been tipped onto said conveying device along said conveyor track using said conveying device to said up-ending apparatus, said up-ending apparatus further transports the flat articles and, in the process, to up-end the flat articles such that, after an up-ending operation, the flat articles each stand on an edge, and the configuration transporting the up-ended articles along said conveyor track from said up-ending apparatus to said separating apparatus.

3. The configuration according to claim 2, wherein said up-ending apparatus has at least two up-ending steps, said up-ending steps are disposed one behind the other, as seen in a transport direction, each of said up-ending steps has a respective oblique plane, said respective oblique plane being rotated in relation to a horizontal about an axis of rotation parallel to the transport direction, and having a greater angle of inclination in relation to the horizontal than a preceding oblique plane in the transport direction.

4. The configuration according to claim 3, wherein said up-ending apparatus additionally has an underfloor conveying device, said oblique plane of at least one of said up-ending steps is formed by a positionally fixed plate, said up-ending apparatus is configured such that the flat articles slide over said positionally fixed plate and drop onto said underfloor conveying device.

5. The configuration according to claim 2, wherein said up-ending apparatus has a further conveying device and an edge, said further conveying device transporting the flat articles to said edge, the configuration is configured such that the flat articles transported to said edge drop off said edge and, after dropping off, are in an approximately vertical position.

6. The configuration according to claim 2, further comprising an aligning apparatus configured to align a flat, aligned and rectangular article into a position in which the flat article is aligned and stands on a longer edge, and the configuration transporting up-ended articles from said up-ending apparatus to said aligning apparatus and to transport up-ended and aligned articles to said separating apparatus.

7. The configuration according to claim 6, wherein:

said aligning apparatus has a downward conveying device, a conveying device leading upward, and a step disposed between said downward conveying devices and said conveying device leading upward; and said aligning apparatus is configured such that said downward conveying device transports the flat articles obliquely downward, the flat articles drop off said step and said conveying device leading upward subsequently transports the flat articles obliquely upward.

8. The configuration according to claim 1, wherein said format-splitting device has a feed transport path, at least one distributing guide, and one removal transport path per said processing device, each said removal transport path leads to a respective said processing device, said format-splitting device configured to direct an article transported on said feed transport path with a use of said at least one distributing guide onto said removal transport path which leads to said processing device capable of processing the article.

9. The configuration according to 1, wherein said separating apparatus includes at least two separators disposed in parallel; and further comprising a dividing component, said dividing component is configured to divide up-ended articles during transport into one stream of articles transported upright per said separator, the configuration transporting each stream to a respective said separator, and each said separator is configured to separate the articles transported to said separator.

* * * * *